US005113810A

United States Patent [19]

Ishii

[11] Patent Number: 5,113,810

[45] Date of Patent: May 19, 1992

[54] MULTI-CYLINDER TWO-CYCLE ENGINE HAVING IMPROVED TRANSFER PASSAGE STRUCTURE

[75] Inventor: Mitsunori Ishii, Yokohama, Japan

[73] Assignee: Nissan Motor Co., Ltd., Yokohama, Japan

[21] Appl. No.: 517,657

[22] Filed: May 1, 1990

[30] Foreign Application Priority Data

May 2, 1989 [JP] Japan ..... 1-112932

[51] Int. Cl. ..... F02B 75/22

[52] U.S. Cl. ..... 123/73 R; 123/73 PP

[58] Field of Search ..... 123/73 PP, 73 B, 73 R, 123/534, 73 V

[56] References Cited

U.S. PATENT DOCUMENTS

| | | | |
|---|---|---|---|
| 4,033,302 | 7/1977 | Jarnuszkiewicz | 123/534 |
| 4,233,717 | 11/1980 | Noda et al. | 123/65 A |
| 4,628,888 | 12/1986 | Duret | 123/534 |
| 4,690,109 | 9/1987 | Ogasahara et al. | 123/73 PP |
| 4,787,344 | 11/1988 | Okumura et al. | 123/65 PE |
| 4,892,066 | 1/1990 | Brown | 123/73 V |
| 4,898,127 | 2/1990 | Phillips et al. | 123/73 A |
| 4,899,698 | 2/1990 | Thery | 123/65 A |
| 4,917,053 | 4/1990 | Okazaki et al. | 123/73 A |
| 4,944,255 | 7/1990 | Duret | 123/73 C |

FOREIGN PATENT DOCUMENTS

| | | | |
|---|---|---|---|
| 111444 | 7/1945 | Fed. Rep. of Germany | 123/73 V |
| 803961 | 2/1951 | Fed. Rep. of Germany | 123/73 B |
| 1037757 | 8/1958 | Fed. Rep. of Germany | 123/73 R |
| 54-11214 | 1/1979 | Japan . | |
| 55-134714 | 10/1980 | Japan . | |
| 58-138221 | 8/1983 | Japan . | |
| 60-149828 | 10/1985 | Japan . | |
| 62-26524 | 2/1987 | Japan . | |
| 62-168961 | 7/1987 | Japan . | |

*Primary Examiner*—David A. Okonsky
*Attorney, Agent, or Firm*—Foley & Lardner

[57] ABSTRACT

A plurality of cylinders have a predetermined firing order. The crank case of the engine is divided by partitions so that each piston has its own crankchamber. Air is induced into the crank chambers via reed valves and subject to compression as the respective piston descends. Transfer ports are provided which open when the pistons have descended by a predetermined amount from TDC and which inject scavenging air from the crankchamber of the previous cylinder on the firing order, into the combustion chamber of the instant cylinder.

5 Claims, 5 Drawing Sheets

MULTI-CYLINDER TWO-CYCLE ENGINE HAVING IMPROVED TRANSFER PASSAGE STRUCTURE

BACKGROUND OF THE INVENTION

1. Field of the Invention

The present invention relates generally to a two cycle engine and more specifically to a two cycle engine in which the crankcase is partitioned into a number of sub-compartments each of which communicate with a transfer passage.

2. Description of the Prior Art

JP-A-58-138221 discloses a previously proposed multi-cylinder 2 cycle engine of the type wherein measures have been exacted in an attempt to reduce the amount of residual combustion gases in the combustion chamber and to improve and/or stabilize combustion characteristics.

In this arrangement air is transferred from a crank chamber via a transfer passage to the combustion chamber in a manner wherein, upon the transfer port being opened (viz., the engine entering the induction phase), a flow of fresh air is injected into the combustion chamber for the purpose of scavenging the residual combustion gases from the combustion chamber and for providing fresh air with which the fuel, injected during the induction phase, can mix to form a combustible charge.

However, this arrangement has suffered from the drawback that each crankchamber additionally communicates with the combustion chamber of an adjacent cylinder by way of a conduit so that a small amount of air can be injected for the purposes of inducing swirl. This reduces the pressure in the crankcase and reduces the efficiency with which air is transferred via the main transfer passages.

SUMMARY OF THE INVENTION

It is an object of the present invention to provide a transfer port arrangment for a multi-cylinder 2 cycle engine which improves the efficiency with which air is transferrred from the crank chamber into the combustion chambers thereof.

In brief, a 2 cycle engine has a plurality of cylinders which have a predetermined ignition sequence or firing order. The crank case of the engine is partitioned so that each piston has its own crankchamber. Air is induced into the crankchambers via reed valves and subjected to compression as the respective piston descends. Transfer ports are provided which open when the pistons have descended by a predetermined amount from TDC and which permit scavenging air from the crankchamber of a different cylinder, to be injected into the combustion chamber.

The charge formed in each of the combustion chambers is ignited just prior to the piston reaching TDC. The resulting combustion produces pressure which drives the piston downwardly during the expansion phase. After a predetermined amount of piston descent the exhaust port opens and the exhaust phase is initiated. At the same time the air in the crank chamber of the instant cylinder is compressed and/or transferred into the combustion chamber of the previous cylinder on the ignition sequence upon the transfer port thereof being opened.

More specifically, a first aspect of the present invention is deemed to comprise a two cycle engine which features: a plurality of cylinders, the cylinders each comprising a bore in which a piston is reciprocatively disposed, the pistons being operatively connected with a crankshaft; a crankcase which encloses the crankshaft; means partitioning the crankcase into a plurality of isolated crankchambers, each crankchamber communicating with a cylinder; a plurality of valves, each of the valves communicating with a crankchamber and permitting air to be inducted thereinto when the piston of the cylinder which communicates with the crankchamber ascends toward a TDC position; and a plurality of transfer passages, each of the transfer passages being arranged to communicate at an upstream end with a crankchamber of one cylinder and to communicate at a downstream end with a transfer port which is formed in the bore of a different cylinder, and each transfer passage defining the only means via which air is supplied to the combustion chamber defined in the cylinder.

Another aspect of the present invention comes in a two cycle engine which features: a plurality cylinders, the cylinders comprising a bore in which a piston is reciprocatively disposed, the pistons being operatively connected with a crankshaft, the cylinders having a predetermined ignition sequence; means partitioning a crankcase which encloses the crankshaft into a plurality of isolated crankchambers, each crankchamber communicating with a cylinder; a plurality of valves, each of the valves communicating with a crankchamber and permitting air to be inducted thereinto when the piston of the cylinder which communicates with the crankchamber ascends toward a TDC position; and a plurality of transfer passages, each of the transfer passages being arranged to communicate at a downstream end with a transfer port formed in the bore of a given cylinder and arranged to communicate at an upstream end with the crankchamber of the cylinder which is next on the ignition sequence, and each transfer passage defining the only means via which air is supplied to the combustion chamber defined in the cylinder.

DETAILED DESCRIPTION OF THE PREFERRED EMBODIMENTS

Figure 1:
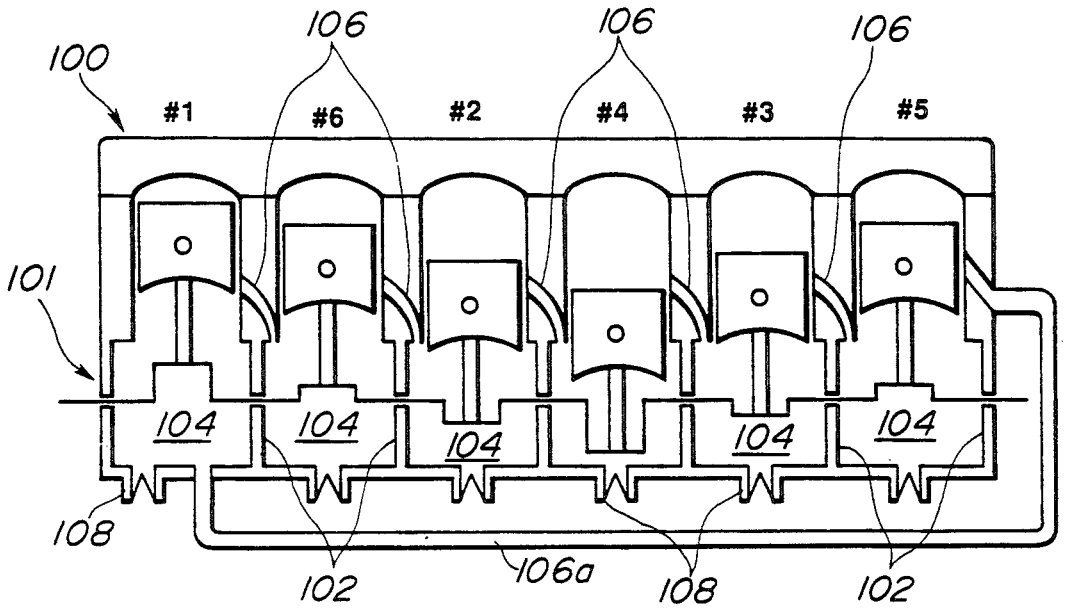
FIG. 1 is a schematic sectional elevation of a 6 cylinder in-line two cycle engine which demonstrates the concept of partitioning the crank case and the manner in which the transfer passages communicate the compartments defined in the crank case with different combustion chambers of the engine.

FIG. 1 shows in schematic elevation a 6 cylinder 2 cycle engine 100. For the sake of clarifying the concept of the present invention this engine is illustrated in an in-line form wherein the cylinders are purposely illustrated in order of ignition sequence rather than the sequence they would normally appear in.

As will be appreciated from this figure, the crank case 101 is formed with a plurality of partition walls 102 which divide the crankcase into six compartments or crankchambers 104 as they will be referred to hereinafter. Transfer passages 106 are arranged to communicate cylinder #1 with the adjacent crankchamber of cylinder #6, cylinder #6 with the adjacent crankchamber of cylinder #2 and so on until the last cylinder. In this case cylinder #5 is communicated with the crankchamber of cylinder #1.

Each of the compartments or crankchambers 104 defined in the crankcase 102 communicate with the ambient atmosphere via a reed valve 108. Although not shown, it is possible that the reed valves are each provided with an air filter or communicated with a single air cleaner.

Figure 2:
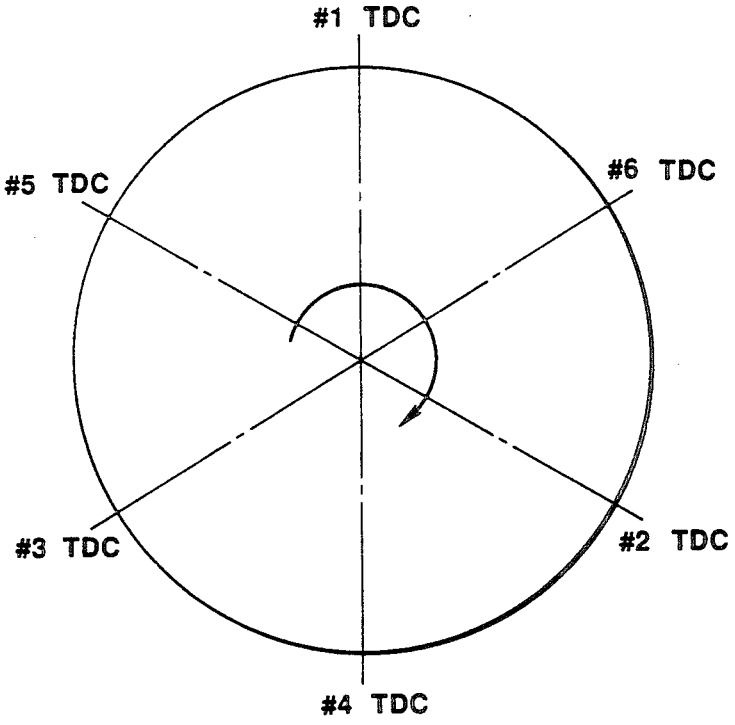
FIG. 2 shows the timing with each of the pistons of the engine shown in FIG. 1.

As will be appreciated from FIGS. 1 and 2, the ignition order of the six cylinders is -#1 -#6 -#2 -#4 -#3 -#5 and takes place at 60° intervals.

Figure 3:
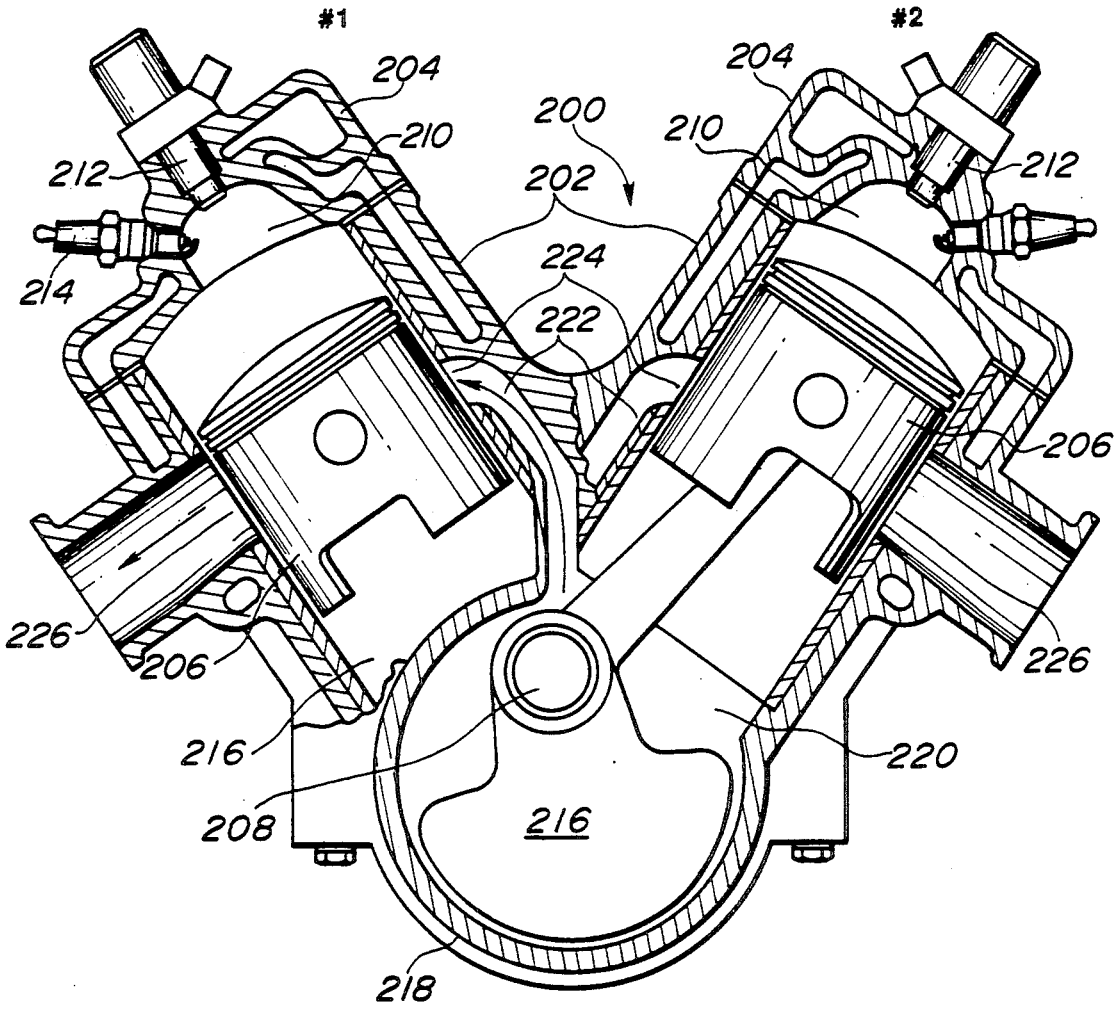
FIG. 3 is a front cross-sectional view of a V-6 2 cycle engine which embodies the transfer port arrangement according to the present invention.
Figure 4:
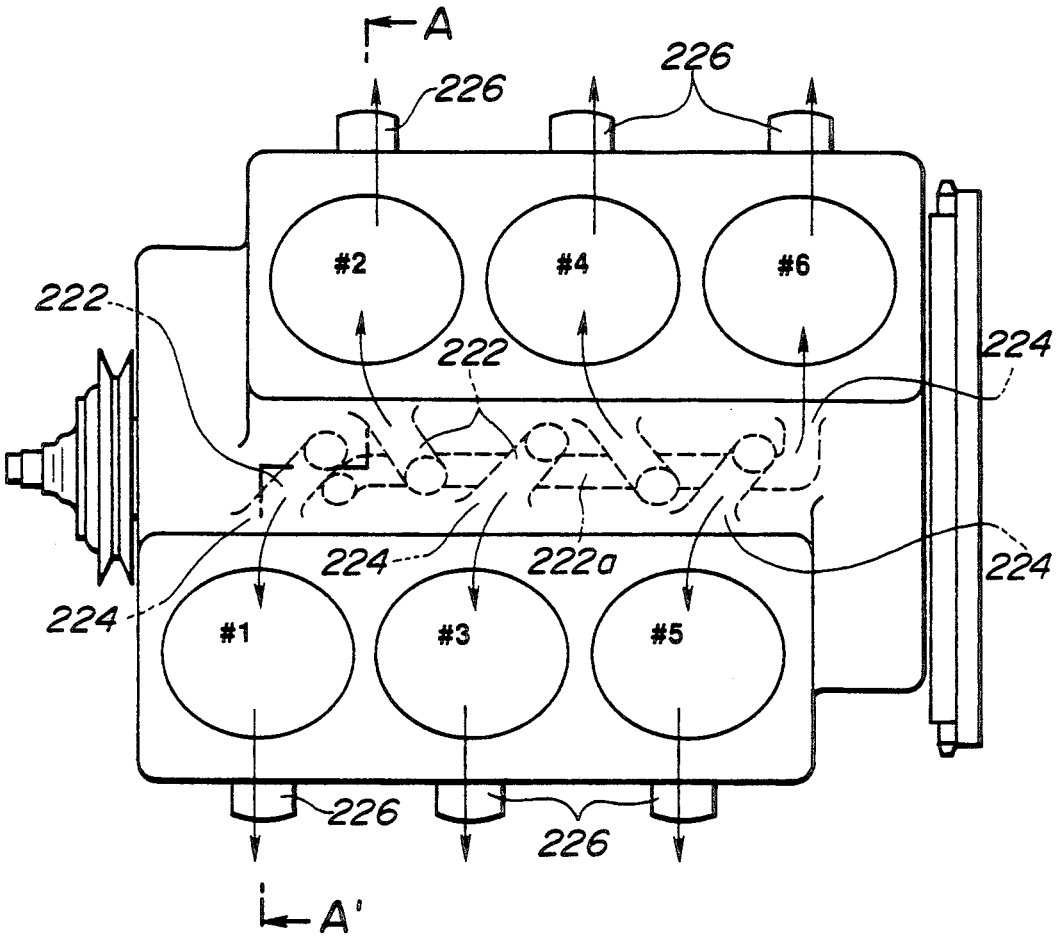
FIG. 4 is a plan view of the engine shown in FIG. 3.

FIGS. 3 and 4 show a practical example of a V-6 cylinder 2 cycle engine which embodies the transfer passage arrangement according to the present invention. This engine has two banks of 3 cylinders -#1, #3 and #5 and #2, #4 and #6. These cylinders are fired at 60° intervals in the following order -#1 -#2 -#3 -#4 -#5 -#6. The two banks of cylinders are defined in a cylinder block 202 and closed by two cylinder heads 204. Pistons 206 are reciprocatively disposed in the cylinders to define combustion chambers. The pistons 206 are operatively connected with a crankshaft 208 by way of connecting rods 209. In this particular instance, the pistons 206 are each slightly domed and arranged to closely approach a cylinder head. A swich area is defined which tends to generate turbulence in a recessed portion 210 of the cylinder head. Fuel injectors 212 and spark plugs 214 are disposed in the cylinder head in the illustrated manner. As will be appreciated, the injectors 212 and spark plugs 214 are disposed in bores which open into the recessed portion 210 of the cylinder head which defines a vital part of the combustion chamber structure.

Figure 5:
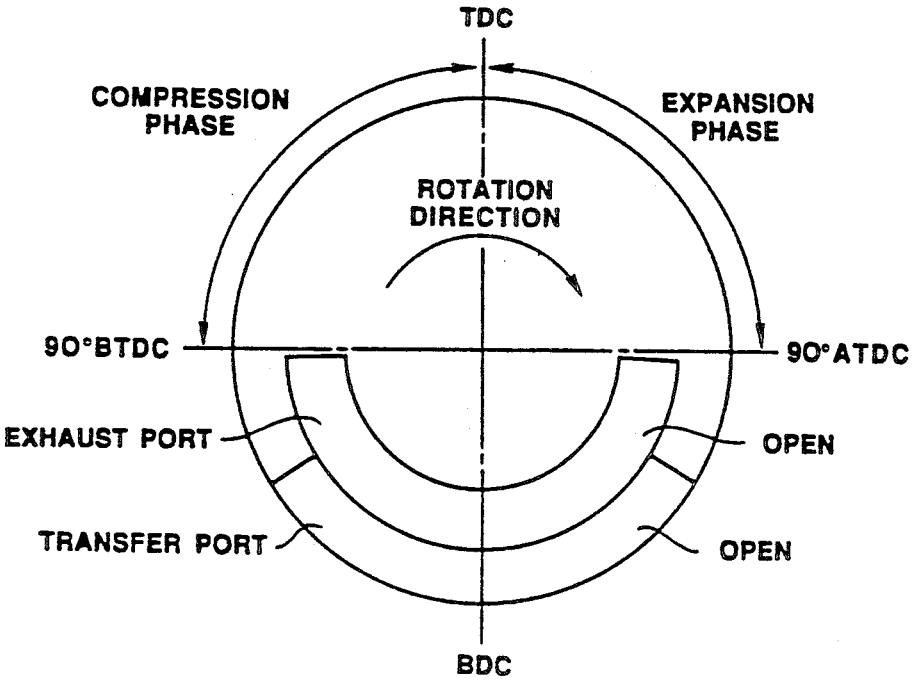
FIG. 5 is a timing chart showing the phases and timing with which the exhaust and transfer ports are opened in accordance with the present invention.

A crankchamber 216 for each cylinder is defined within the crankcase 218 by partitioning walls 220. Transfer passages 222 lead from crankchambers 216 to transfer ports 224 formed in the side of the cylinder bore. Exhaust ports 226 are formed in the bore walls at locations which are essentially opposite the transfer ports. As shown in FIG. 5 the exhaust ports 226 are arranged to open before the transfer ports 224 and to remain open for a longer period. In this case the exhaust port 226 of each cylinder is arranged to open at approximately 90° ATDC and close at about 90° BTDC. On the other hand, the transfer port 224 of each cylinder is arranged to open about 150° ATDC and close about 150° BTDC.

As will be best appreciated from FIG. 4, in this embodiment the transfer passages 222 are arranged in a manner wherein the passage which leads to cylinder #1 fluidly communicates with the crankchamber of cylinder #2, the passage which leads to cylinder #3 fluidly communicates with the crankchamber of cylinder #4 and so on. However, as in the case of FIG. 1 the transfer passage for the last cylinder, viz., #6, communicates with the crankchamber of cylinder #1 via relatively long transfer passage 222*a*.

The operation of the engine illustrated in FIGS. 3 and 4 is such that as each piston 206 rises to a level (90° BTDC) whereat the corresponding exhaust port 226 is closed, the charge in the cylinder undergoes compression. Fuel is then injected into the combustion chamber and the spark plugs 214 are energized just prior to TDC. Following ignition of the charge, the pressure in the combustion chamber rises very rapidly and after having passed TDC the piston is driven downwardly thereby.

During the upward movement of each piston, the volume of the corresponding crankchamber 216 increases and air is inducted thereinto via reed valves (not shown in this embodiment). During the descent of the piston toward BDC, the air in the crank chamber 216 is subject to compression. When the piston descends by a predetermined amount and the transfer port 224 is opened, the air which is compressed in the crankchamber 216 of the next cylinder (on the firing order or ignition sequence) is transferred via the transfer passage 222 and injected into the instant combustion chamber. The air which is compressed in the crankchamber 216 of the instant cylinder is transferred into the combustion chamber of previous cylinder upon the transfer port 224 of said cylinder being opened, and so on.

In this manner while the transfer port 224 of each cylinder is open, air at a suitable pressure is transferred through the transfer passage 222 which leads to said cylinder thus improving scavenging of the same.

Figure 6A:
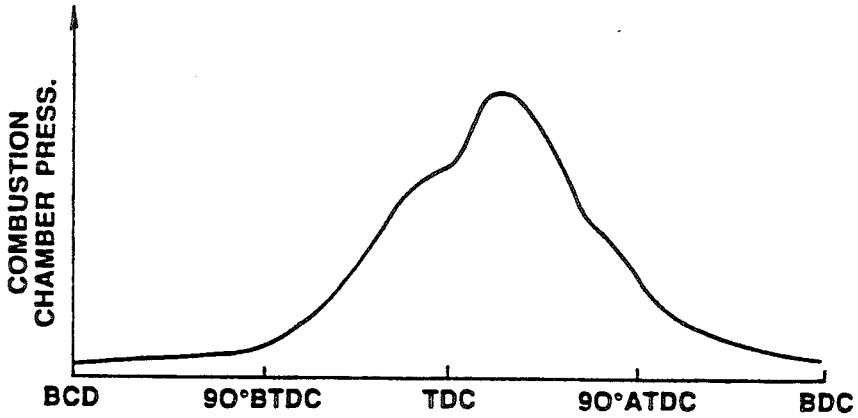
FIGS. 6A and 6B are timing charts which show the manner in which the pressure in the combustion and crank chambers of the engine shown in FIGS. 1 and 2, vary.
Figure 6B:
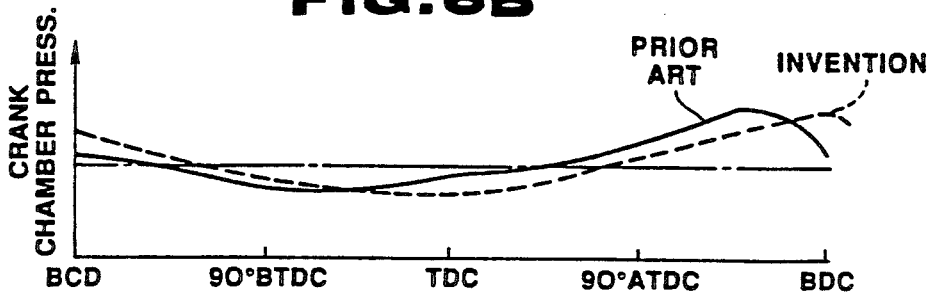

FIG. 6 shows a typical example of how the pressures in the respective combustion chambers and crankchambers of each cylinder, vary. In this figure the crankchamber pressure which develops with the present invention is indicated by the broken line trace while that which occurs with the prior art arrangement is denoted by the solid line trace.

As will be appreciated, in accordance with the present invention, crank pressure minimizes when a piston reaches its TDC position and gradually increases to a maximum at BDC. On the other hand, the pressure in the prior art tends to maximize well prior BDC.

Figure 7:
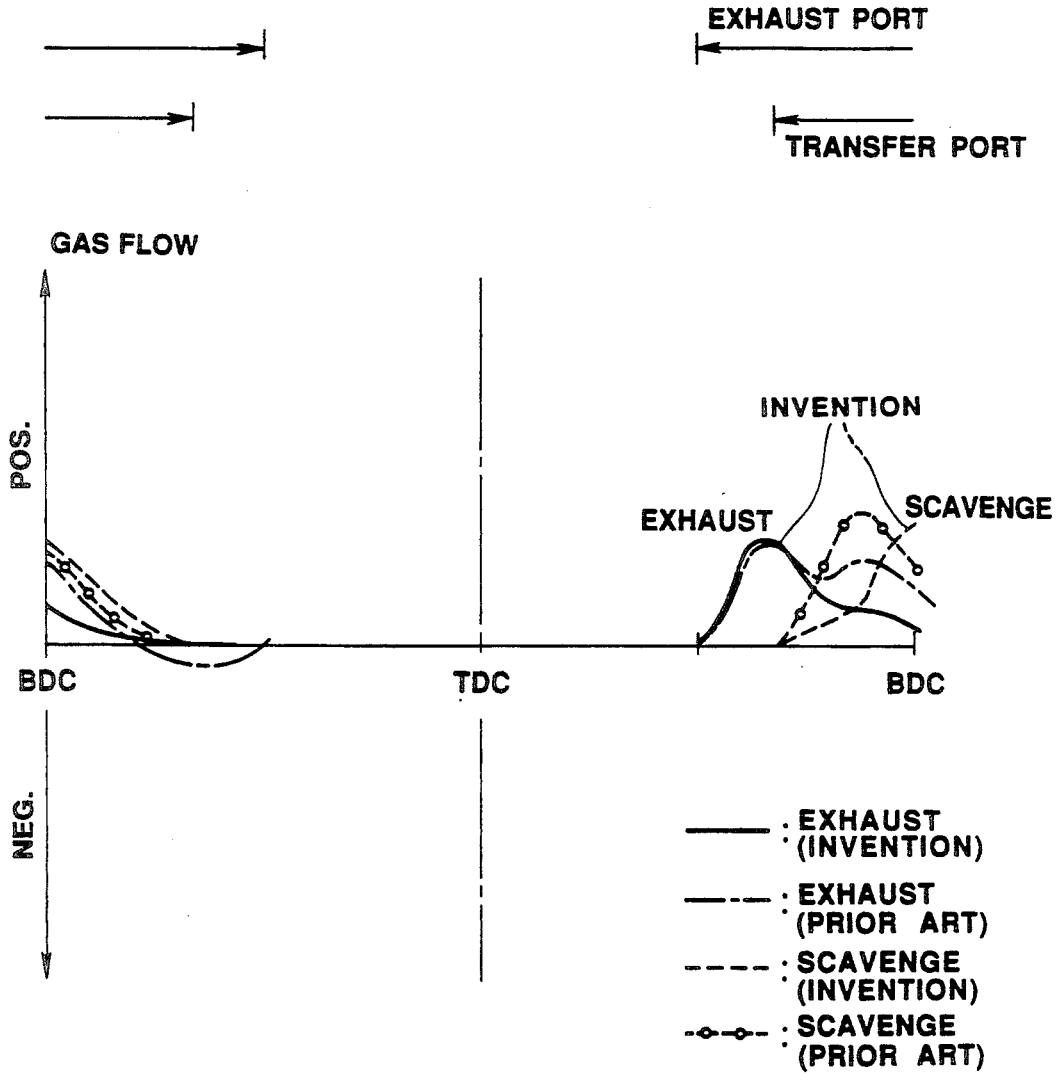
FIG. 7 is a timing chart which shows the relationship between the gas flow in the exhaust and transfer ports for the present invention and the above mentioned prior art arrangement.

FIG. 7 shows the fluid flow characteristics which are achieved in the above described prior art type arrangement and the present invention during the period spanning the exhaust and induction phases. As will be noted, in the present invention the main flow of scavenging air is delayed as compared with the prior art and takes place at a time when the exhaust flow has reduced notably. This improves the reduction in the amount of residual combustion gases in the chamber and subsequently results in improved combustion stability. Improved engine power output and reduced noxious emissions accordingly result.

The present invention also obviates the tendency for negative or back exhaust flow to take place and thus further adds to the reduction of the amount of residual gas which becomes trapped in the combustion chamber and is mixed with fresh charge during the compression phase.

It will be appreciated that the present invention is not limited to six cylinder engines nor to in-line or V-type engines and can be applied to any multi-cylinder two cycle engine wherein it is possible to partition the crankcase into separate crankchambers and use transfer passages to selectively connect the crankchambers with the combustion chambers of different cylinders.

What is claimed is:

1. In a two cycle engine a plurality of cylinders, the cylinders each comprising a bore in which a piston is reciprocatively disposed and which defines a combustion chamber in the bore, said pistons being operatively connected with a crankshaft;

a crankcase which encloses the crankshaft;

means partitioning the crankcase into a plurality of isolated crankchambers, each crankchamber communicating with a cylinder;

a plurality of valves, each of the valves communicating with a crankchamber and permitting air to be inducted thereinto when the piston of the cylinder which communicates with the crankchamber ascends toward a TDC position; and a plurality of transfer passages, each of the transfer passages being arranged to communicate at an upstream end with the crankchamber of one cylinder and to communicate at a downstream end with a transfer port which is formed in the bore of a different cylinder, and each transfer passage defining the only means via which air is supplied to the combustion chamber defined in the cylinder.

2. A two cycle engine as claimed in claim 1 wherein each cylinder is formed with an exhaust port, the exhaust and transfer ports of each cylinder being arranged in a manner wherein the exhaust port is opened before the transfer port and is closed after the transfer port.

3. In a two cycle engine a plurality of cylinders, the cylinders comprising a bore in which a piston is reciprocatively disposed to form a combustion chamber, the pistons being operatively connected with a crankshaft, the cylinders having a predetermined ignition sequence;

means partitioning a crankcase which encloses the crankshaft into a plurality of isolated crankchambers, each crankchamber communicating with a cylinder;

a plurality of valves, each of the valves communicating with the crankchamber and permitting air to be inducted thereinto when the piston of the cylinder which communicates with the crankchamber ascends toward a TDC position; and a plurality of transfer passages, each of the transfer passages being arranged to communicate at a downstream end with a transfer port formed in the bore of a given cylinder and arranged to communicate at an upstream end with the crankchamber of the cylinder which is next on the ignition sequence, and each transfer passage defining the only means via which air is supplied to the combustion chamber defined in the cylinder.

4. A two cycle engine as claimed in claim 3 wherein each of the transfer ports faces toward the transfer port of another cylinder.

5. A two cycle engine as claimed in claim 4 wherein the engine has six cylinders which are arranged in two banks of three cylinders each.

* * * * *